US005379474A

United States Patent [19]

Nakamura

[11] Patent Number: 5,379,474

[45] Date of Patent: Jan. 10, 1995

[54] FINGERTIP WASHER

[75] Inventor: Masahiko Nakamura, Higashiosaka, Japan

[73] Assignee: GS Food Corporation, Osaka, Japan

[21] Appl. No.: 136,919

[22] Filed: Oct. 18, 1993

Related U.S. Application Data

[63] Continuation-in-part of Ser. No. 991,556, Dec. 15, 1992, abandoned.

[30] Foreign Application Priority Data

Dec. 16, 1991 [JP] Japan ..... 3-103466[U]
Apr. 27, 1992 [JP] Japan ..... 4-027515[U]

[51] Int. Cl.[6] ..... A45D 29/17; A46B 13/02

[52] U.S. Cl. ..... 15/21.1; 15/160; 132/73.6

[58] Field of Search ..... 15/21.1, 97.1; 132/73.6

[56] References Cited

U.S. PATENT DOCUMENTS

| | | | |
|---|---|---|---|
| 1,366,306 | 1/1921 | Wick | 132/73 |
| 2,580,981 | 1/1952 | Webster | 15/21.1 |
| 4,016,618 | 4/1977 | Kobayashi | 15/21.2 |
| 4,180,884 | 1/1980 | Hess et al. | 15/21.1 |
| 4,255,826 | 3/1981 | Boyd | 15/21.1 |
| 4,800,606 | 1/1989 | Kolesky | 15/97.1 |

FOREIGN PATENT DOCUMENTS

| | | | |
|---|---|---|---|
| 140991 | 10/1934 | Australia | 15/167.3 |
| 2263722 | 10/1975 | France | 15/21.1 |
| 562600 | 9/1972 | Switzerland | 15/21.1 |

*Primary Examiner*—Edward L. Roberts
*Attorney, Agent, or Firm*—Wenderoth, Lind & Ponack

[57] ABSTRACT

A fingertip washer has a disk-shaped bottom plate and a vertical peripheral wall provided around the bottom plate and planted in the inner surface thereof with numerous cleaning hairs as an annular brush. High-speed rotary brushes each driven by a planetary gears are mounted on the bottom plate. They are adapted to revolve about the center of the bottom plate together with the bottom plate and at the same time rotate about their own axes. Further, a flat rotary brush is fixedly mounted on the bottom plate.

1 Claim, 3 Drawing Sheets

FINGERTIP WASHER

BACKGROUND OF THE INVENTION

The present application is a continuation-in-part application of the U.S. patent application No. 07/991,556 filed Dec. 15, 1992, abandoned.

This invention relates to a fingertip washer which can efficiently remove dirt that has penetrated into between fingertips and fingernails.

Though the palm or back of a hand can be cleaned with relative ease, it is not an easy job to remove dirt that has penetrated into between fingertips and fingernails of a hand of a factory worker or the like. For this purpose, brushes formed on a plastic base and planted with monofilaments made of plastic are usually used.

Such a conventional brush has a flat base plate. Hairs are planted in the flat surface of the base plate. Thus, hair tops delineate a flat plane. In order to brush off dirt stuck on the curved surfaces of fingertips with this type of brush, the fingertips have to be rubbed against the brush hairs while inclining them at various angles. This is troublesome and time-consuming.

An object of this invention is to provide a fingertip cleaner which is free of the above-discussed problems of prior art brushes and which can quickly remove dirt stuck between fingertips and fingernails of hands.

SUMMARY OF THE INVENTION

In accordance with the present invention, there is provided a fingertip washer comprising a disk-shaped bottom plate having a peripheral wall provided along the outer circumference of the bottom plate and planted with a multiplicity of hairs in the inner periphery thereof, a rotary shaft fixed to the center of the disk-shaped bottom plate, a driving means for rotating the rotary shaft in either direction, small disks loosely mounted in said bottom plate near its outer circumference so as to be moved by the bottom plate in a circumferential direction of the bottom plate when the bottom plate is rotated about its rotation axis by the driving means, and means for rotating the small disks about their own axes when the snail disks are moved by the bottom plate, the small disks being planted in the top surfaces thereof with a multiplicity of hairs, the bottom plate being planted in its top surface with a multiplicity of hairs.

According to the present invention, the rids of the four fingers of a hand other than the thumb can be cleaned at the same time simply by pressing them against the annular brush. On the other hand, the high-speed rotary brushes and the flat rotary brush provided on the disk-shaped bottom plate serve to completely remove any dirt stuck between the thumb tips and nails or any dirt on nail surfaces or sides of any fingers.

Other features and objects of the present invention will become apparent made with reference to the accompanying drawings, in which:

DETAILED DESCRIPTION OF THE PREFERRED EMBODIMENT

Figure 1:
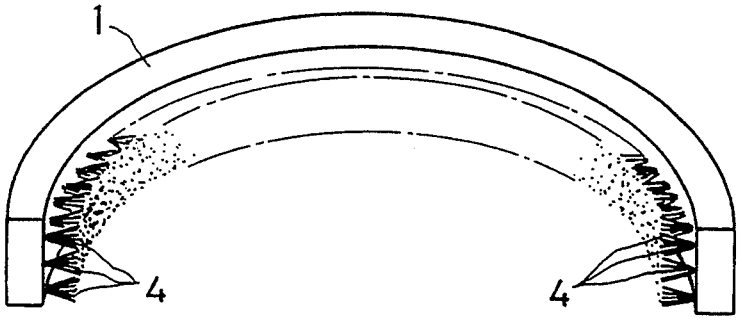
FIG. 1 is a perspective view of one embodiment.

The embodiment shown in FIG. 1 is in the form of an arcuate base plate 1 having a large number of hairs 4 planted in its inner peripheral surface.

The base plate 1 of this embodiment may be formed by angularly dividing an annular ring made of a hard plastic into a plurality of arcuate portions. Also, it may be in the form of an annular ring not divided.

Figure 2:
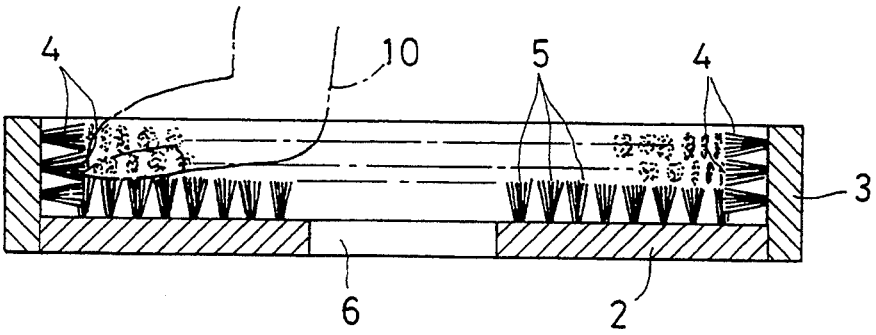
FIG. 2 is a vertical sectional front view of another embodiment.
Figure 3:
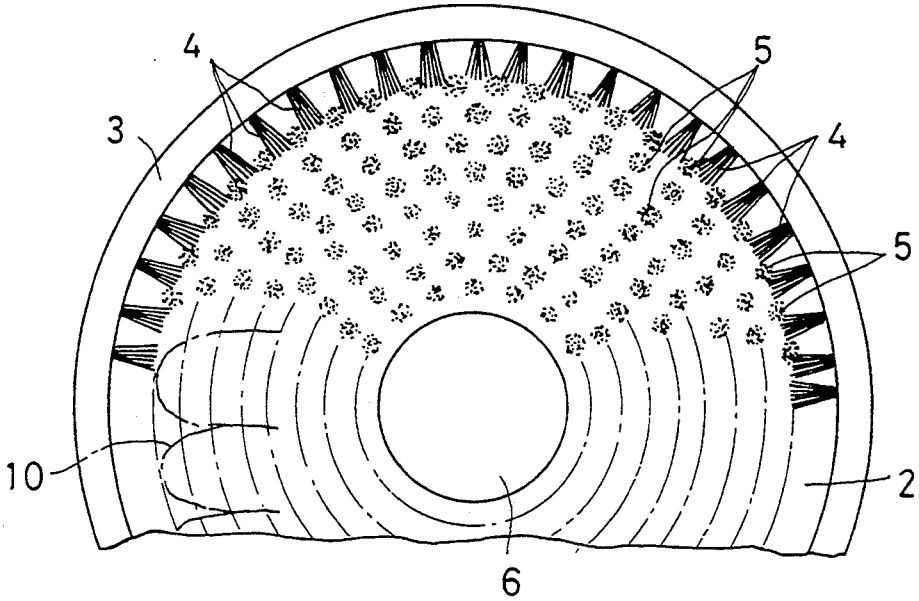
FIG. 3 is a partially cutaway plan view of the same.

The embodiment shown in FIGS. 2 and 3 comprises a disk-shaped bottom plate 2 and a peripheral wall 3 integral with the bottom plate 2. A great number of hairs 4 are planted in the inner surface of the peripheral wall 3. Also, a great number of hairs 5 are planted in the top surface of the bottom plate 2 which has a center hole 6.

In the embodiment shown in FIGS. 2 and 3, the bottom plate 2 and the peripheral plate 3 are made of a hard plastic as in the first embodiment. The hairs 4 and 5 may be planted when forming them.

But, it is difficult to plant the hairs 4 directly in the concave inner surface of the base plate 1 or the peripheral wall 3 which are made of hard plastic in the embodiments shown in FIGS. 1 and 3.

Figure 4:
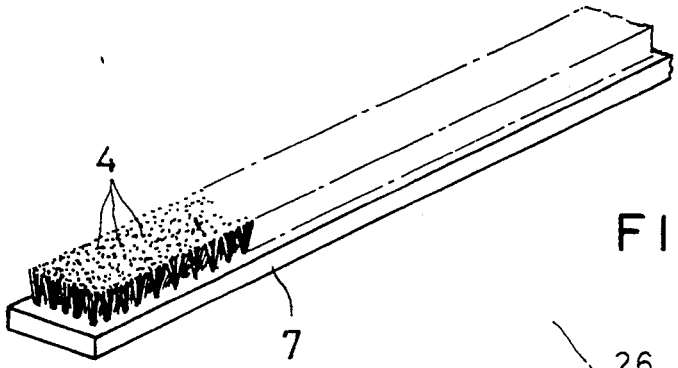
FIG. 4 is a perspective view of the web-shaped brush.

In order to avoid this difficulty, in the embodiment shown in FIG. 4, hairs may be planted in a strip 7 made of rubber or a rubber-like plastic and the strip 7 is stuck on the inner surface of the base plate 1 or the peripheral wall 3 by means of adhesive.

Now, we shall explain how to use the brushes shown in FIGS. 1–3. First, the base plate or the bottom plate 2 grasped by one hand and four fingers of the other hand, that is, index, middle, medical and little fingers are held side by side. In this state, the portions between the tips and nails of these fingers are pressed against the hairs 4 as shown by chain lines 10 in FIG. 3 and moved right and left repeatedly. Thus, the dirt stuck between the fingertips and the fingernails are removed by the hairs 4.

In the embodiment shown in FIGS. 2 and 3, any dirt stuck on the nail surfaces and the sides of the fingers can be removed by the hairs 5 planted in the bottom plate 2 simultaneously.

Figure 5:
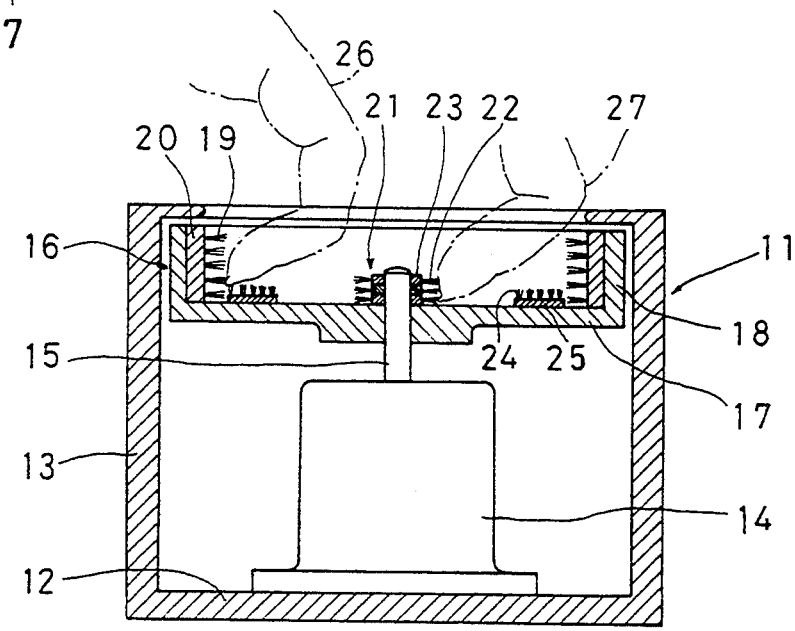
FIG. 5 is a vertical sectional side view of still another embodiment.
Figure 6:
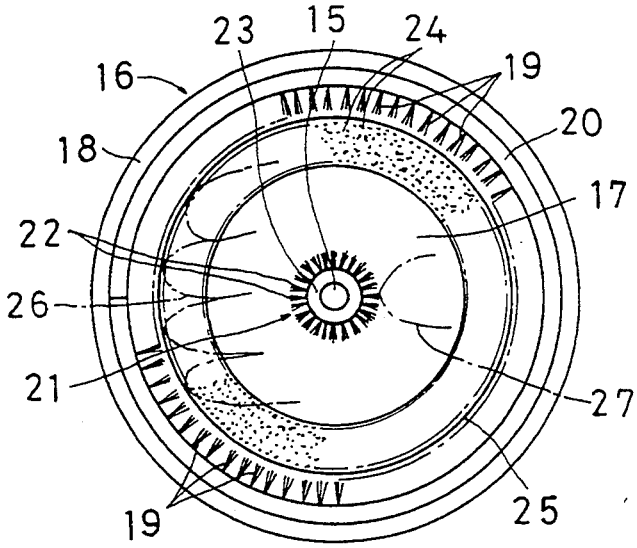
FIG. 6 is a plan view of the fingertip washer of the same.

The embodiment shown in FIGS. 5 and 6 shows a motor-driven automatic fingertip washer. In the figures, numeral 11 designates a case comprising a bottom plate 12 and a peripheral wall 13.

A driving unit 14 in the form of a reversible motor is fixedly mounted on the bottom of the case 11, its rotary shaft 15 extending coaxially with the peripheral wall 13.

Numeral 16 designates a fingertip washer.

It comprises a disk-shaped bottom plate 17 and a peripheral wall 18 extending upwardly from the edge of the bottom plate 17. Numerous hairs 19 are planted in the inner peripheral surface of the peripheral wall 18.

The bottom plate 17 and the peripheral wall 18 are integrally formed of a hard plastic. As described before, it is difficult to plant the hairs 19 directly in the peripheral wall 18.

For this reason, in the embodiment, the hairs 19 are planted first in a strip 20 made of rubber or a rubber-like plastic and the strip 20 is stuck with an adhesive on the inner surface of the peripheral wall 18. Thus, hairs can be planted easily.

The rotary shaft 15 is inserted in a hole formed in the center of the bottom plate 17 and fixed thereto, so that the fingertip washer 16 can be rotated in both directions.

The rotary shaft 15 protrudes from the top surface of the bottom plate 17 and to this protruding portion is secured a small-diameter rotary brush 21 comprising a plurality of rings 23 planted with numerous hairs 22.

An annular plate 25 made of rubber or plastic and planted with numerous hairs 24 is stuck with an adhesive or the like on the top surface of the bottom plate 17 so as to be concentrical with it. Hairs may be planted directly to the bottom plate 17.

The hairs 4, 5, 19, 22 and 24 are made of a soft and resilient material. For example, they may be monofilaments made of nylon or a polyamide plastic.

In use, four fingers, that is, index, middle, medical and little fingers are held side by side and pressed against the hairs 19 and 24 as shown by chain lines 26 in FIGS. 5 and 6, while keeping the washer rotating back and forth with the driving unit 14. The hairs 19, rotating back and forth, are thrust into between the fingertips and the fingernails, thus scrubbing and removing dirt.

In order to remove dirt between a thumb tip and nail, the thumb is pressed against the hairs 22 on the central small-diameter rotary brush 21. Further, the fingers are pressed against the hairs 24 planted in the bottom plate 17 to remove dirt completely.

Figure 7:
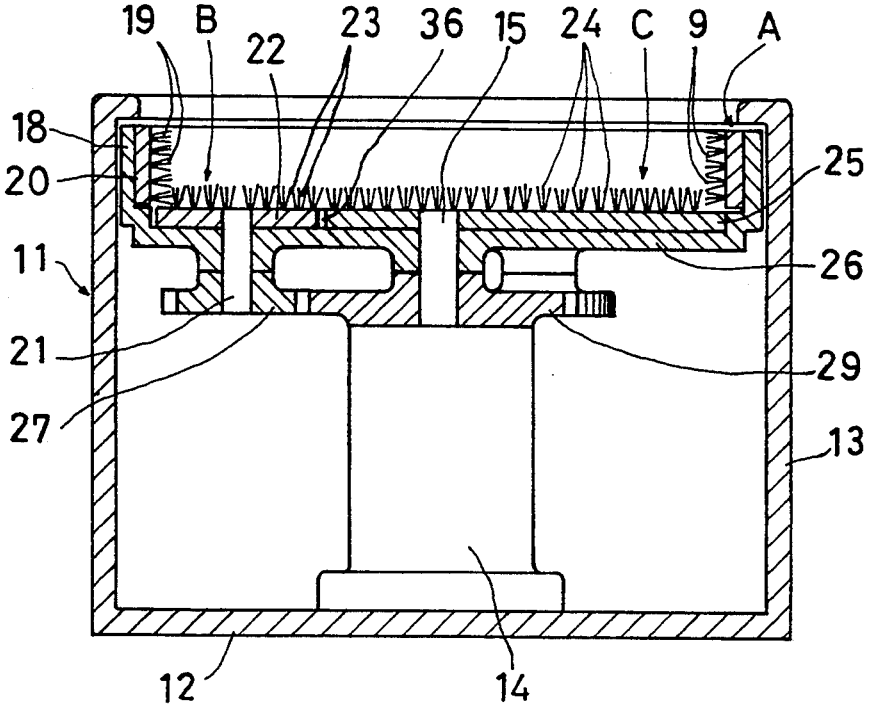
FIG. 7 is a vertical sectional front view of a further embodiment.
Figure 8:
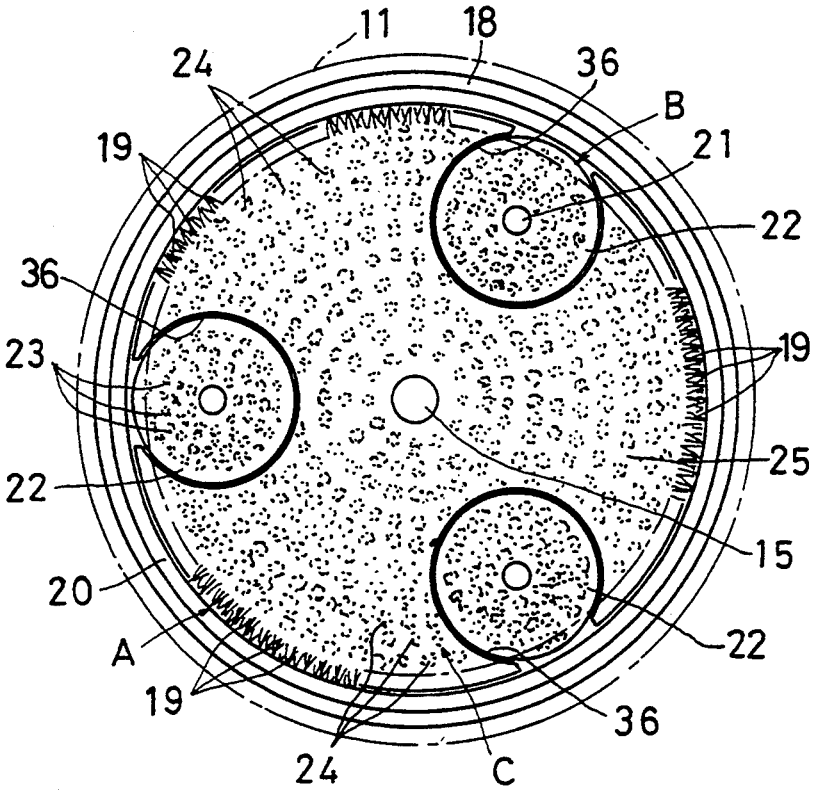
FIG. 8 is a plan view of the same.

In the embodiment shown in FIG. 7, a case 11 comprises a bottom wall 12 and a peripheral wall 13.

On the bottom wall 12 of the case 11 is mounted a driving device 14 in the form of a reversible motor, its rotary shaft 15 extending coaxially with the peripheral wall 13.

An annular brush A is mounted in the case 11. It comprises a disk-shaped bottom plate 28 and a peripheral wall 18 integrally provided around the bottom plate 28 and planted in its inner surface with numerous hairs 19 for cleaning.

The bottom plate 28 and the peripheral wall 18 are integrally formed of a hard plastic. It is thus difficult to plant the hairs 19 directly in the peripheral wall 18.

Thus, in this embodiment, hairs 19 are planted first in a strip 20 made of rubber or a rubber-like plastic and the strip 20 planted with hairs is stuck with an adhesive on the inner surface of the peripheral wall 18. Thus, the hairs can be planted easily.

The rotary shaft 15 is inserted in a hole formed in the center of the bottom plate 28 and fixed thereto, so that the bottom plate 28 can be rotated in both directions. Besides the center hole, the bottom plate 28 has a plurality of (three in the embodiment) holes near its outer circumference through which rotary shafts 21 extend. On top of each rotary shaft 21 is secured a small disk 22 plated with numerous cleaning hairs 23 in the top surface thereof. The disks 22 serve as high-speed rotary brushes B.

A large-diameter disk 25 planted with numerous cleaning hairs 24 is secured to the top surface of the bottom plate 28. The bottom plate 28 and the disk 25 planted with the hairs 24 serve as a large-diameter flat rotary brush C. The disk 25 has the circular holes 36 near its outer periphery in which are loosely received the small disks 22.

To the bottom ends of the rotary shafts 21 are secured planetary gears 27 which are in meshing engagement with a sun gear 29 secured to the driving device 14. The Rotary shaft 15 rotatably extends through the center of the sun gear 29.

Now in operation, the peripheral wall 18 planted with hairs 19 or the annular brush A is rotated in either direction. Thus, by pressing the tips of the four fingers other than the thumb of a hand against the hairs 19 of the annular brush A, any dirt stuck between the fingertips and the nails can be quickly scrubbed off by the hairs 19. The tip of the thumb is pressed against the hairs 24 of the flat rotary brush C provided on the large-diameter disk 25. Since the high-speed rotary brushes B are rotating at high speed together with the flat rotary brush C, any dirt stuck between the tip of the thumb and its nail can be removed very quickly simply by pressing the thumb against the hairs 23 of the brushes B.

What is claimed is:

1. A fingertip washer comprising a disk-shaped bottom plate having a peripheral wall provided along the outer circumference of said bottom plate and planted with a multiplicity of hairs in the inner periphery thereof, a rotary shaft fixed to the center of said disk-shaped bottom plate, a driving means for rotating said rotary shaft in either direction, small disks loosely mounted in said bottom plate near its outer circumference so as to be moved by said bottom plate in a circumferential direction of said bottom plate when said bottom plate is rotated about its rotation axis by said driving means, and means for rotating said small disks about their own axes when said small disks are moved by said bottom plate, said small disks being planted in the top surfaces thereof with a multiplicity of hairs, said bottom plate being planted in its top surface with a multiplicity of hairs.

* * * * *